US009314907B2

(12) United States Patent
Wang

(10) Patent No.: US 9,314,907 B2
(45) Date of Patent: Apr. 19, 2016

(54) ANTI-DISENGAGEMENT STRUCTURE OF A TOOL HEAD FOR A FASTENER

(71) Applicant: Shyh-Ming Wang, Taichung (TW)

(72) Inventor: Shyh-Ming Wang, Taichung (TW)

( * ) Notice: Subject to any disclaimer, the term of this patent is extended or adjusted under 35 U.S.C. 154(b) by 255 days.

(21) Appl. No.: 14/165,584

(22) Filed: Jan. 28, 2014

(65) Prior Publication Data

US 2015/0209941 A1 Jul. 30, 2015

(51) Int. Cl.

| | |
|---|---|
| ***B25B 15/00*** | (2006.01) |
| ***B25B 23/00*** | (2006.01) |
| ***B25B 23/10*** | (2006.01) |
| ***B25B 15/02*** | (2006.01) |

(52) U.S. Cl.

CPC ..... *B25B 15/001* (2013.01); *B25B 15/005* (2013.01); *B25B 15/007* (2013.01); *B25B 15/008* (2013.01); *B25B 15/02* (2013.01); *B25B 23/106* (2013.01); *B25B 23/108* (2013.01)

(58) Field of Classification Search

CPC .... B25B 23/10; B25B 23/106; B25B 23/108; B25B 15/001; B25B 15/005; B25B 15/007; B25B 15/008; B25B 15/02

USPC ..... 81/448

See application file for complete search history.

(56) References Cited

U.S. PATENT DOCUMENTS

| | | | | | |
|---|---|---|---|---|---|
| 1,951,652 | A * | 3/1934 | Fedotoff | B25B 23/106 | 81/448 |
| 2,800,822 | A * | 7/1957 | Allred | B25B 13/06 | 81/125 |
| 3,286,749 | A * | 11/1966 | Learned | B25B 13/06 | 81/125 |
| 4,007,768 | A * | 2/1977 | Matsushima | B25B 15/008 | 81/448 |
| 4,060,113 | A * | 11/1977 | Matsushima | B25B 15/005 | 81/125 |
| 4,060,114 | A * | 11/1977 | Matsushima | B25B 15/005 | 81/448 |
| 4,105,056 | A * | 8/1978 | Arnn | B25B 15/007 | 81/436 |
| 5,237,893 | A * | 8/1993 | Ryder | B25B 23/108 | 81/436 |
| 6,684,741 | B2 * | 2/2004 | Blackston | B25B 23/105 | 81/436 |
| 6,971,293 | B2 * | 12/2005 | Appenzeller | B25B 23/108 | 81/125 |
| 7,017,457 | B2 * | 3/2006 | Nessbaum | A61B 17/8875 | 81/177.85 |
| 7,137,322 | B2 * | 11/2006 | Mark | A61B 17/888 | 81/436 |
| 7,140,281 | B1 * | 11/2006 | Ruff | B25B 15/008 | 81/448 |
| 7,174,615 | B2 * | 2/2007 | Mark | A61B 17/888 | 29/270 |
| 7,249,544 | B2 * | 7/2007 | Totsu | B25B 23/108 | 81/448 |
| 8,262,670 | B2 * | 9/2012 | Laubert | A61B 17/861 | 606/104 |
| 8,640,575 | B2 * | 2/2014 | Huang | B25B 13/481 | 81/436 |
| 2001/0022120 | A1 * | 9/2001 | Mark | A61B 17/888 | 81/452 |

* cited by examiner

*Primary Examiner* — David B Thomas

(57) ABSTRACT

An anti-disengagement structure of a tool head for insertion into an insertion recess of a fastener is provided. Abutting faces extend from a periphery of an end face of a working portion. At least one abutting face is partly formed with a groove filled with an elastic member which is partly protrusive out of the groove and beyond the surface of the abutting face. The largest extent between the protruded-out part of the elastic member and the abutting face of another elastic member is larger then the largest inner extent of the insertion recess. Thereby, with the stretchable characteristic of the elastic member, the fastener can be smoothly inserted into the insertion recess and abutted against an inner surface of the insertion recess to achieve anti-disengagement effect.

6 Claims, 14 Drawing Sheets

ANTI-DISENGAGEMENT STRUCTURE OF A TOOL HEAD FOR A FASTENER

BACKGROUND OF THE INVENTION

1. Field of the Invention

The present invention relates to a tool head.

2. Description of the Prior Art

Hand tool or power tool can fasten or unfasten a fastener quickly and is effort-saving. A tool head is used to fasten or unfasten the fastener. Generally, the tool head may be a flat tool head, Phillips tool head, hexagonal tool head, ball-shaped tool head or Torx tool head, and is exchangeably connected to a driving end of a driving tool. However, the tool head may be broadly considered to include socket. To avoid disengagement of the socket from the fastener, the socket is generally provided with a magnetic member on the inner surface thereof, or with a structure which includes an elastic abutting member disposed in an opening on the inner surface and an elastic annular member disposed around the socket, so as to engage with the fastener. As to the flat tool head, Phillips tool head, hexagonal tool head, ball-shaped tool head or Torx tool head which has a small size, the working end thereof is too thin to allow arrangement of the magnetic member or the elastic abutting member. TWM460727 is directed to an extension rod provided with a magnetic member or elastic abutting member; however, it cannot avoid disengagement of the fastener from the tool head.

DE 4416268 is directed to a hexagonal wrench and U.S. Pat. No. 6,302,001 is directed to a ball-shaped tool head. In DE 4416268 or U.S. Pat. No. 6,302,001, a working end is formed with an annular groove and an O-ring is received in the annular groove, wherein the O-ring is partially protrusive outside the annular groove to avoid disengagement of a fastener from the tool head. However, there will exist disadvantages as recited below.

1. The working end has a smallest diameter at the portion that is formed with the annular groove, and this will affect the application of force of the tool head.

2. For receiving the O-ring, the annular groove has an opening width greater than the diameter of a cross section of the O-ring, so that the O-ring can move slightly and the O-ring is possible to disengage from the annular groove during insertion of the working end into a fastener, which cannot avoid disengagement of a fastener from the tool head.

3. In U.S. Pat. No. 6,302,001, an annular groove is formed along a portion which has the largest diameter of the ball-shaped tool head having plural ramps. The largest diameter of the ball-shaped tool head is smaller than the width of an insertion recess of a fastener, and the O-ring is a little protrusive outside the annular groove. This structure would not affect the application of force to the fastener when the ball-shaped tool head is perpendicularly inserted into the insertion recess; however, it does affect the application of force to the fastener when the ball-shaped tool head is non-perpendicularly inserted into the insertion recess since the O-ring just very slightly contact the inner surface of the insertion recess and is very slightly deformed to engage with the inner surface of the insertion recess, and thus the fastener can disengage from the tool head easily.

4. The tool head of U.S. Pat. No. 5,259,280 is provided with particles of friction material consisting of metallic or mineral material so as to avoid disengagement of a fastener from the tool head. However, to facilitate insertion of the tool head into an insertion recess of a fastener without affect of the particles, the thickness of the tool head has to be reduced, thus degrading the structural strength and output torque of the tool head.

In structure of U.S. Pat. No. 6,883,405, a workpiece engagement surface is irradiated over a large area and/or locally with a high level of energy, such that a region of an irradiated zone which is close to the surface melts and solidifies suddenly at an edge to form a rib, so as to increase the friction of the tool head and a fastener to avoid disengagement of the fastener from the tool head. However, it is complicated and difficult to form the rib at the edge of the small-sized tool head, and the solidified rib is rigid and undeformable. Furthermore, the structure of U.S. Pat. No. 6,883,405 has defects of poor structural strength and lower output torque.

As to a small-sized tool head having size identification mark, it is not easy to recognize the size just via the size identification mark, especially in a dark environment. Thereupon, the middle body of a tool head would be colored in black, electroplated or spray-coated, such as disclosed in TWM457613 and TWM437766. To provide identification, some kind of tool head is formed with plural annular grooves, and plural colored rings are received in the annular grooves of the tool head, such as disclosed in TWM434656; some kind of tool head is formed with colored protrusion(s), such as disclosed in I358347.

The above-mentioned structures have complicated production process and high production cost. The structures provided with colored rings or protrusion(s) can be recognized only in a bright environment but difficult to be recognized in a dark environment. Generally, for small-sized tool head (especially slotted or Phillips tool head), it is still a hard issue that how to provide a tool head which can avoid disengagement of the fastener from the tool head and has identification effect, without degrading the structural strength of the working end and without any additional process and cost tool head.

The present invention is, therefore, arisen to obviate or at least mitigate the above mentioned disadvantages.

SUMMARY OF THE INVENTION

An object of the present invention is to provide an anti-disengagement structure of a tool head for a fastener which can avoid disengagement of the fastener from the tool head and enable an user to easily recognize the size, type and application of the tool head.

Another object of the present invention is to provide an anti-disengagement structure of a tool head for a fastener which can enable an user to obtain the size, type and application of the tool head through touch in either of bright or dark environments.

To achieve the above and other objects, an anti-disengagement structure of a tool head for a fastener is for insertion into an insertion recess of the fastener to fasten or unfastening the fastener. The tool head includes a main body, and the main body having an operation portion and a working portion. The working portion axially integrally extends from one end of the operation portion. A top end of the working portion has an end face. At least two abutting faces extend from a periphery of the end face toward the operation portion. A depth of each of the abutting faces corresponding to one the insertion recess is defined as a working inserting section. The largest outer extent of the working inserting section is smaller than or equal to the largest inner extent of the insertion recess. At least one the abutting face corresponding to the working inserting section is formed with at least one groove, and the groove is filled with an elastic member. Part of the elastic member is protrusive outside the groove and exposed beyond the abutting face. The largest extent from the exposed part of the elastic member to another abutting face is greater than the largest inner extent of the insertion recess.

To achieve the above and other objects, an anti-disengagement structure of a tool head for a fastener is for insertion into an insertion recess of the fastener to fasten or unfastening the fastener. The tool head includes a main body, and the main body having an operation portion and a working portion. A necked portion is formed between the working portion and the operation portion. A top end of the working portion has an end face. A plurality of < -shaped abutting faces which are sequentially connected extend from a periphery of the end face toward the operation portion. Outmost parts of two corresponding < -shaped abutting faces define a working inserting section. The largest outer extent of the working inserting section is smaller than or equal to the largest inner extent of the insertion recess. At least one the < -shaped abutting face corresponding to the working inserting section is formed with a groove running through a transition interface of the at least one < -shaped abutting face, and the groove is filled with an elastic member. Part of the elastic member is protrusive outside the groove and exposed beyond the at least one the < -shaped abutting face. The largest extent from the exposed part of the elastic member to one the < -shaped abutting face opposite to the exposed part of the elastic member is greater than the largest inner extent of the insertion recess.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

An anti-disengagement structure of a tool head for a fastener according to a preferred embodiment of the present invention is provided. The tool head may be a flat tool head, Phillips tool head, hexagonal tool head (or extension rod), ball-shaped tool head, Torx tool head et al. Besides, a driver or hexagonal tool (but is not limited thereto) may include the aforementioned tool head.

Figure 1:
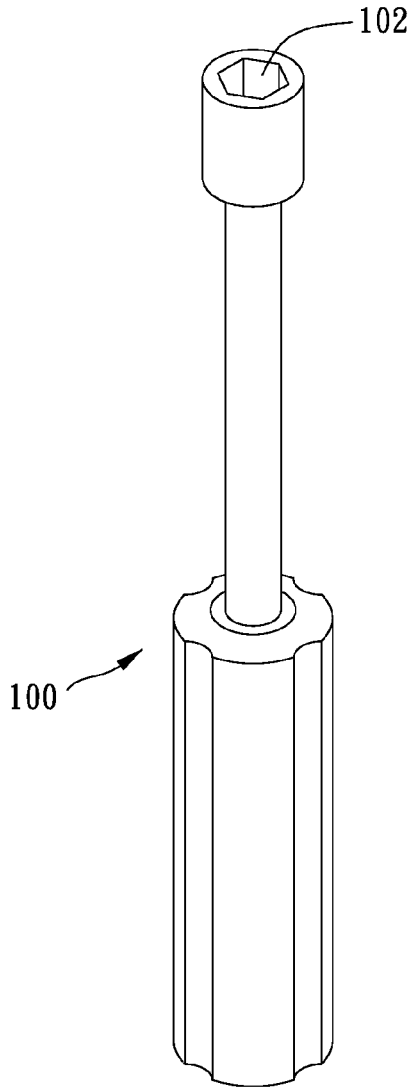
FIG. 1 is a drawing of an assisting tool.
Figure 1A:
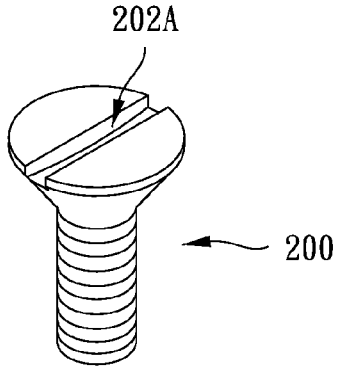
FIGS. 1A to 1C are drawings of fasteners each having different insertion recesses.
Figure 1B:
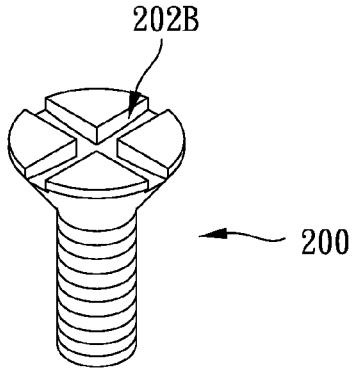
Figure 1C:
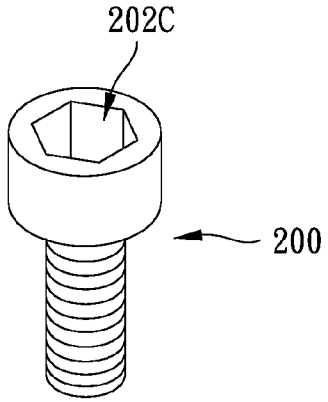

According to a preferred embodiment of the present invention, the anti-disengagement structure is for connection of a driving end 102 of an assisting tool 100 (working end 1) so that a working end of the tool head can be inserted into a slotted insertion recess 202A (working end 1A), crossed insertion recess 202B (working end 1B) or hexagonal insertion recess 202C (FIG. 1C) of a fastener 200 to fasten or unfastening the fastener.

FIGS. 2 and 2A-2D show an anti-disengagement structure of a tool head for a fastener according to a first embodiment of the present invention. The flat tool head 1 includes a main body 10 made of metal and having an operation portion 12 and a working portion 14. The working portion 14 axially integrally extends from one end of the operation portion 12, and the operation portion 12 is inserted in the driving end 102 of the assisting tool. The operation portion 12 has a polygonal cross section, and a top end of the working portion 14 has an end face 142. From a periphery of the end face 142 toward the operation portion extends to form symmetrical first abutting face 144 and second abutting face 144' and symmetrical first side face 146 and second side face 146'. The first and second side faces are connected with the first and second abutting faces. a depth of first and second abutting faces corresponding to the slotted insertion recess 202A of the fastener 200 is defined as a working inserting section W. The largest outer extent of the two abutting faces within the working inserting section W is smaller than or equal to the largest inner extent of the slotted insertion recess 202A. The first abutting face 144 corresponding to the working inserting section is formed with a groove 1442, and the groove 1442 is filled with an elastic member 300. Part of the elastic member 300 is protrusive outside the groove 1442 and exposed beyond the first abutting face 144. The largest extent from the exposed part of the elastic member 300 to another abutting face is greater than the largest inner extent of the slotted insertion recess 202A. Preferably, the groove extends and terminates at the end face 142, and the groove is filled with the elastic member in a manner that the elastic member is substantially aligned with the end face. Preferably, the elastic member is partially protrusive from and beyond the end face. Preferably the abutting face and the groove are designed according to various requirements, for example, to avoid degradation of structure due to lots of arrangements of the working inserting section W. Preferably, the groove of the abutting face or/and the end face may correspond to the flat tool head 1 in shape and is filled with the elastic member, for user to recognize the function and type of the tool head via visual observation. The slotted elastic member may be provided with various or gradient colors so as to facilitate recognizing the size and application of the flat tool head.

Figure 3:
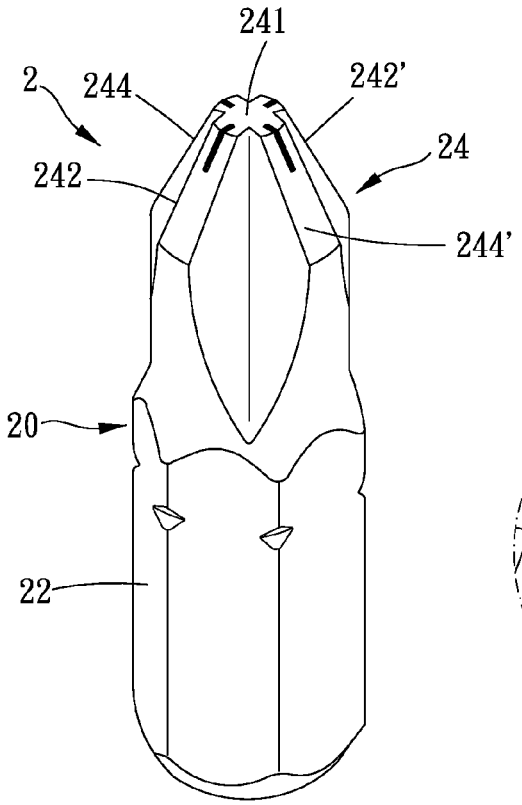
FIG. 3 is a view of a Phillips tool head.
Figure 3A:
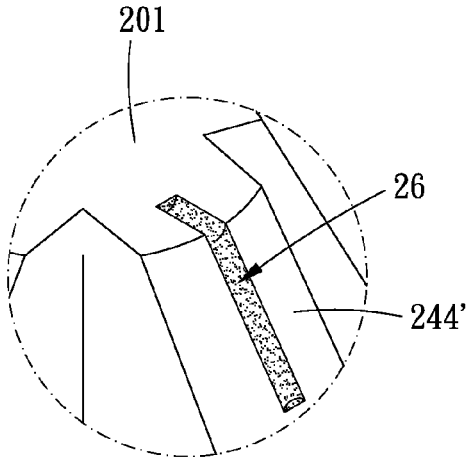
FIGS. 3A and 3B are partial views of FIG. 3.
Figure 3B:
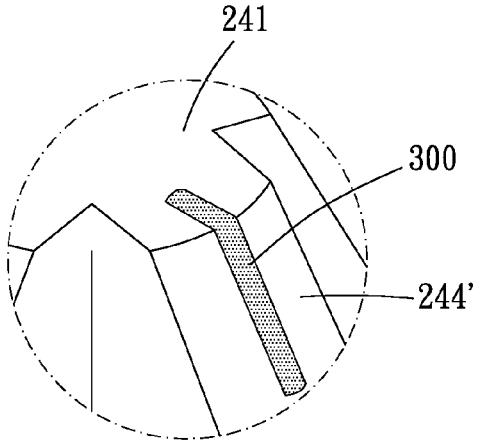

FIGS. 3, 3A and 3B show an anti-disengagement structure of a tool head for a fastener according to a second embodiment of the present invention. The tool head is a Phillips tool head 2. The Phillips tool head has a main body 20 having an operation portion 22 and a working portion 24. The working portion 24 has an end face 241. From a periphery of the end face toward the operation portion extends to form symmetrical first abutting face 242 and second abutting face 242' and to form symmetrical third abutting face 244 and fourth abutting face 244'. The third and fourth abutting faces and the first and second abutting faces are shaped as crossed, for facilitating insertion into the crossed insertion recess 202B of the fastener Phillip. A depth of each of the abutting faces corresponding to the crossed insertion recess 202B (FIG. 3C) is defined as a working inserting section W. The largest extent of the working inserting section (referring to an extent from the first abutting face to the second abutting face or from the third abutting face to the fourth abutting face) is smaller than the largest inner extent of a corresponding portion of the crossed insertion recess 202B. Each abutting face corresponding to the working inserting section W is formed with a groove 26. Preferably, the groove extends and terminates at the end face. Preferably, the groove 26 may correspond to the crossed insertion recess of the Phillips tool head in shape (FIG. 3D, 3E) and is filled with an elastic member 300. The elastic member is partially protrusive outside the groove 26 so that the diameter of the elastic member 300 between the first and second abutting faces (or between the third and fourth abutting faces) is greater than the largest inner extent of the crossed insertion recess.

Figure 4:
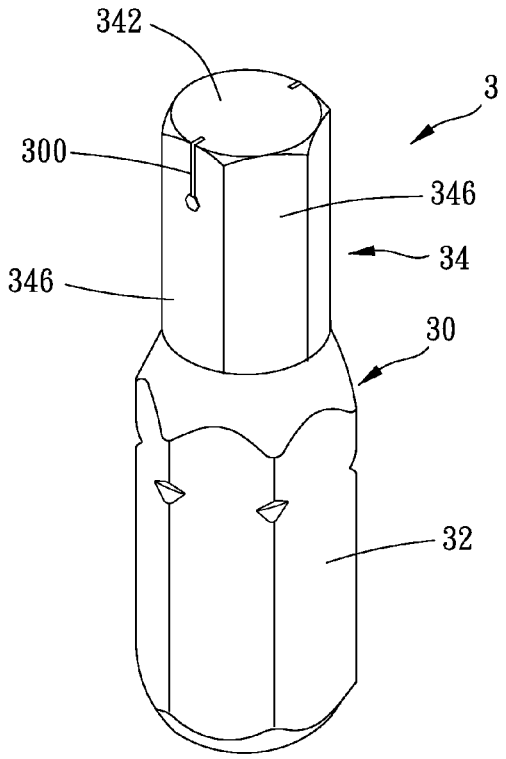
FIG. 4 is a view of a hexagonal tool head.
Figure 4A:
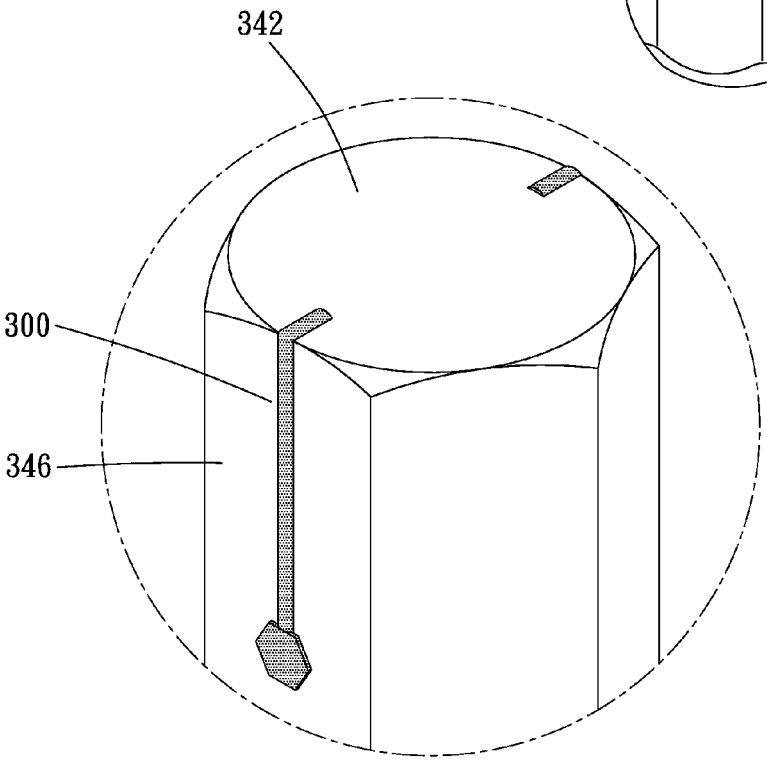
FIG. 4A is an enlarged view of FIG. 4.
Figure 4B:
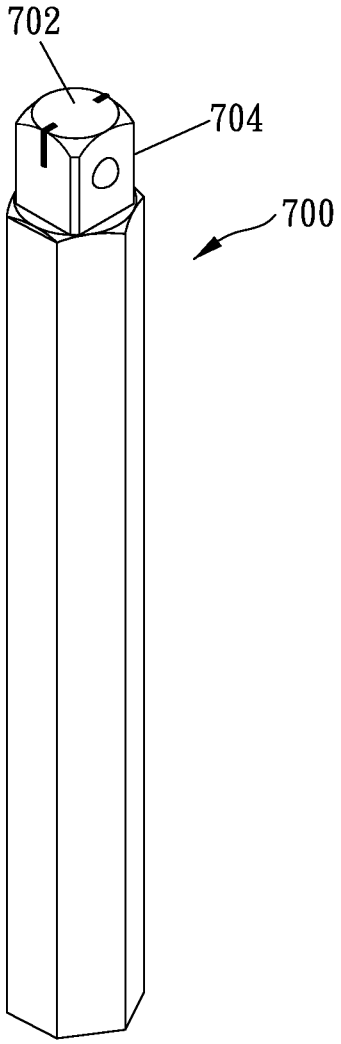
FIG. 4B is a view of an extension rod tool.

FIGS. 4 and 4A show an anti-disengagement structure of a tool head for a fastener according to a third embodiment of the present invention. The tool head 3 is a hexagonal tool head. The hexagonal tool head has a main body 30 having an operation portion 32 and a working portion 34. The working portion 34 has an end face 342. From a periphery of the end face toward the operation portion extends six abutting faces 346 sequentially connected and forming a hexagonal shape. A depth of each abutting face inserted into a hexagonal insertion recess 202C of the fastener is defined as a working inserting section. At least two corresponding abutting faces 346 which are located on the largest extent of corresponding portion of the working inserting section each is provided with a groove. Preferably, the groove extends on the abutting face and the end face 342 and is shaped as an L-shape. The L-shaped groove is filled with an elastic member 300, and the elastic member 30 is partially protrusive outside the groove and beyond the abutting face (part of the elastic member 30 on the end face may be optionally aligned with or protrusive outside the groove). The largest extent of two corresponding parts of the elastic member between two corresponding abutting faces is greater than the largest inner extent of the hexagonal insertion recess 202C. Preferably, the groove may be provided to be hexagonal and filled with the elastic member, in which the elastic member may be protrusive outside the groove (to have a polygonal profile) to enable an user to recognize the size and type of the tool head. In an alternative embodiment, an extension rod tool 700 as shown in FIG. 4B, wherein four abutting faces 704 extend from a periphery of an end face 702 of the extension rod tool 700 toward the operation portion, for connection with a socket.

Figure 5:
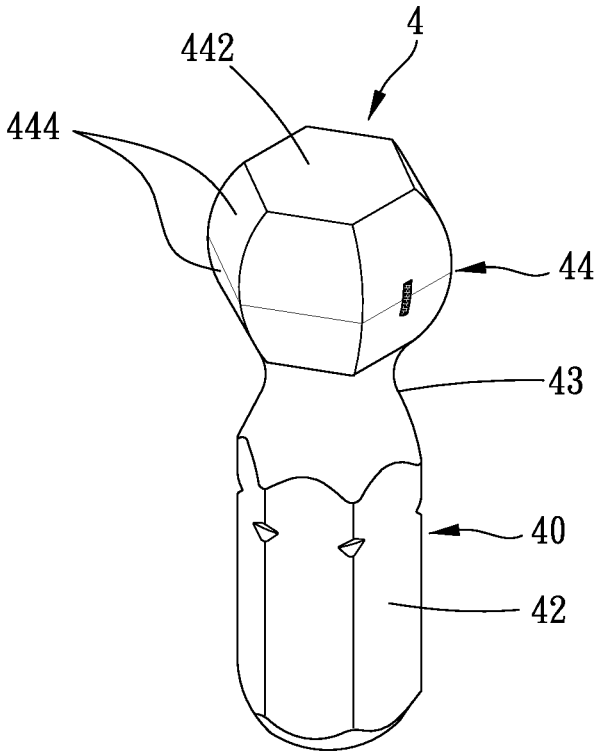
FIG. 5 is a view of a ball-shaped tool head.
Figure 5A:
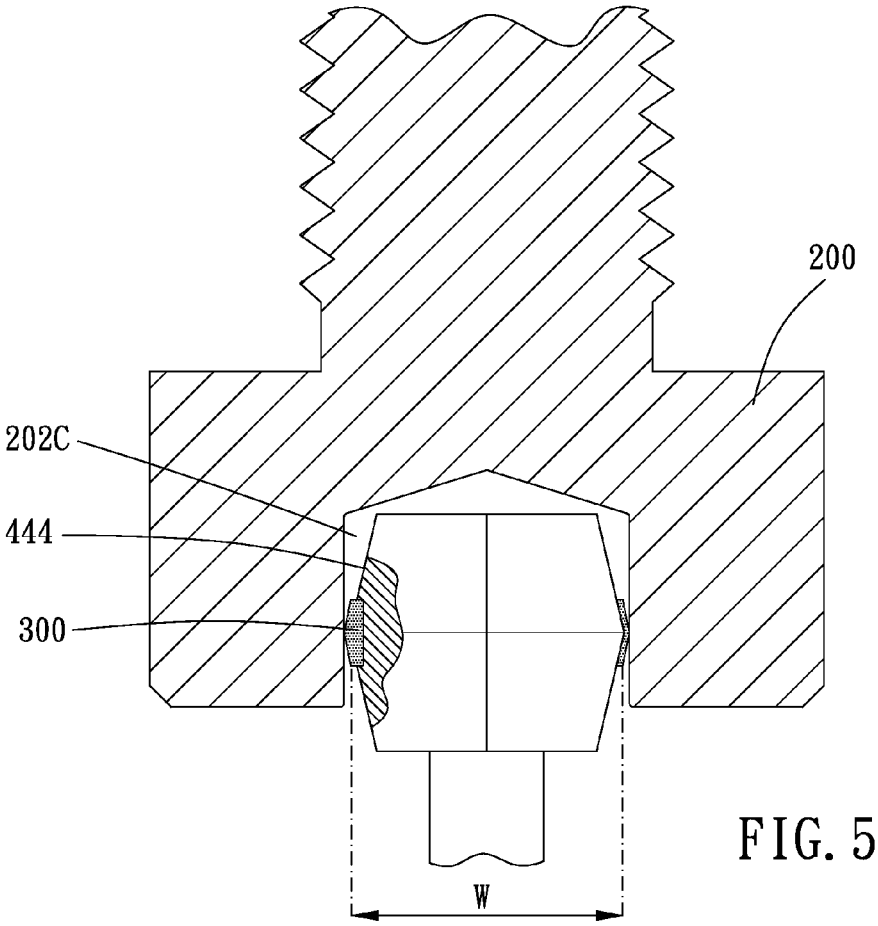
FIG. 5A is a view showing a ball-shaped tool head perpendicularly inserted into a fastener.
Figure 5B:
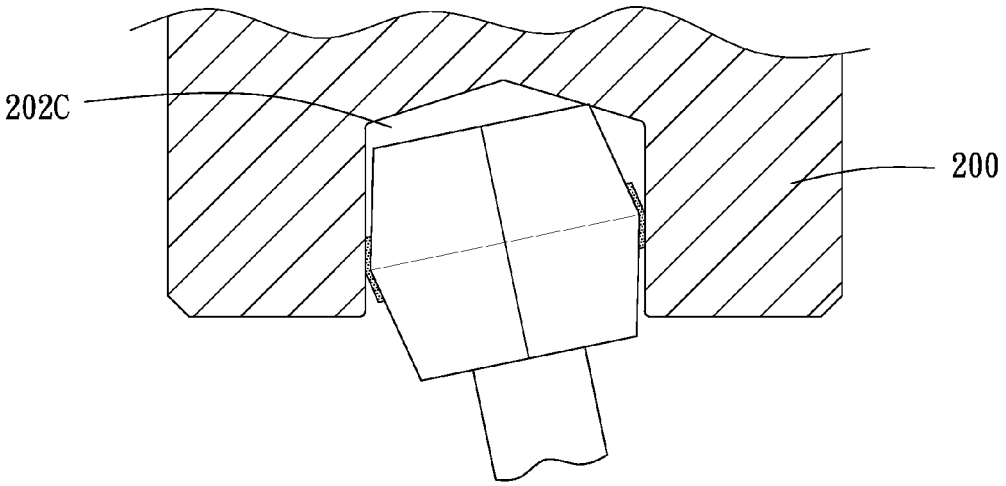
FIG. 5B is a view showing a ball-shaped tool head non-perpendicularly inserted into a fastener.

FIGS. 5, 5A and 5B show an anti-disengagement structure of a tool head for a fastener according to a fourth embodiment of the present invention. The tool head is a substantially ball-shaped tool head 4. Compared to the third embodiment, the ball-shaped tool head is provided with a necked portion 43 between an operation portion 42 and an working portion 44 of the main body 40. Six ‹-shaped abutting faces 444 which are sequentially connected extend from a periphery of an end face 442 of the working portion toward the operation portion. The ‹-shaped here may be similar to boomerang-shaped. The ‹-shaped abutting face has an upper ramp and a lower ramp which extend oppositely. Outmost parts of two corresponding ‹-shaped abutting faces 444 is defined as a working inserting section W. The largest outer extent of the working inserting section W is smaller than or equal to the largest inner extent of the hexagonal insertion recess 202C, at least one the ‹-shaped abutting face 444 corresponding to the working inserting section W is formed with a groove running through a transition interface of the at least one ‹-shaped abutting face 444. Preferably, the groove continuously extends on the upper ramp and the lower ramp and travels through the transition interface of the upper ramp and the lower ramp, and the groove is filled with an elastic member 300. The elastic member 300 is partially protrusive outside the groove and beyond the ‹-shaped abutting face. The largest extent from the protrusive part of the elastic member to one the ‹-shaped abutting face opposite to the protrusive part of the elastic member is greater than the largest inner extent of the hexagonal insertion recess 202C. Preferably, each ‹-shaped abutting face may be provided with the groove, or either of two corresponding ‹-shaped abutting faces located on the largest extent of the working inserting section W may be formed with one the groove.

Figure 6:
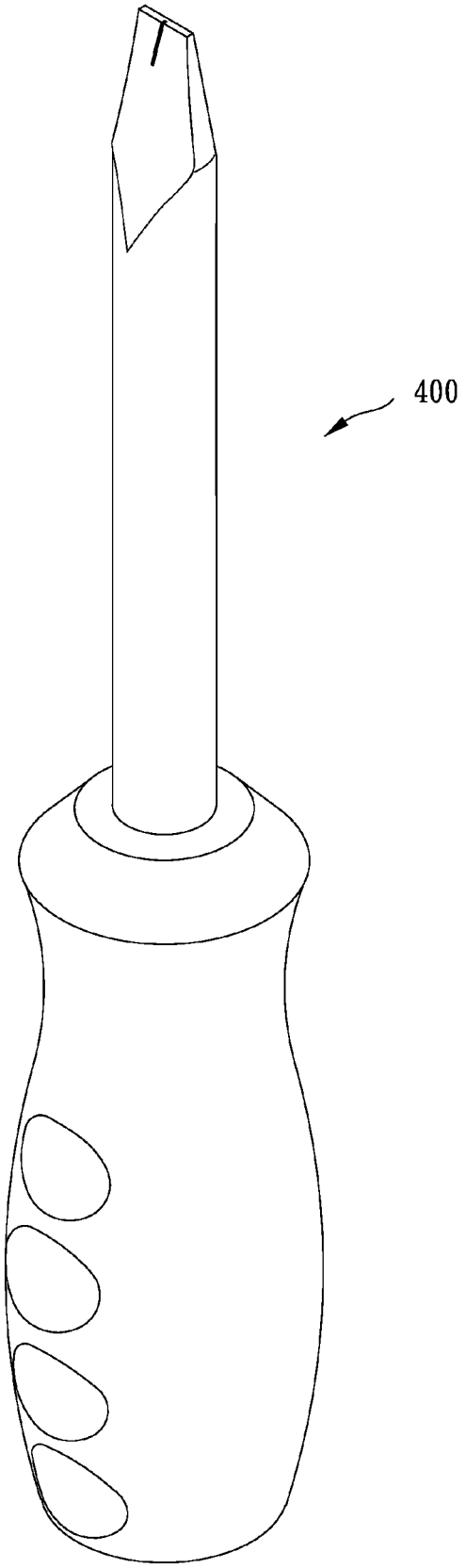
FIG. 6 is a view of a slotted screwdriver according to a preferred embodiment of the present invention.
Figure 7:
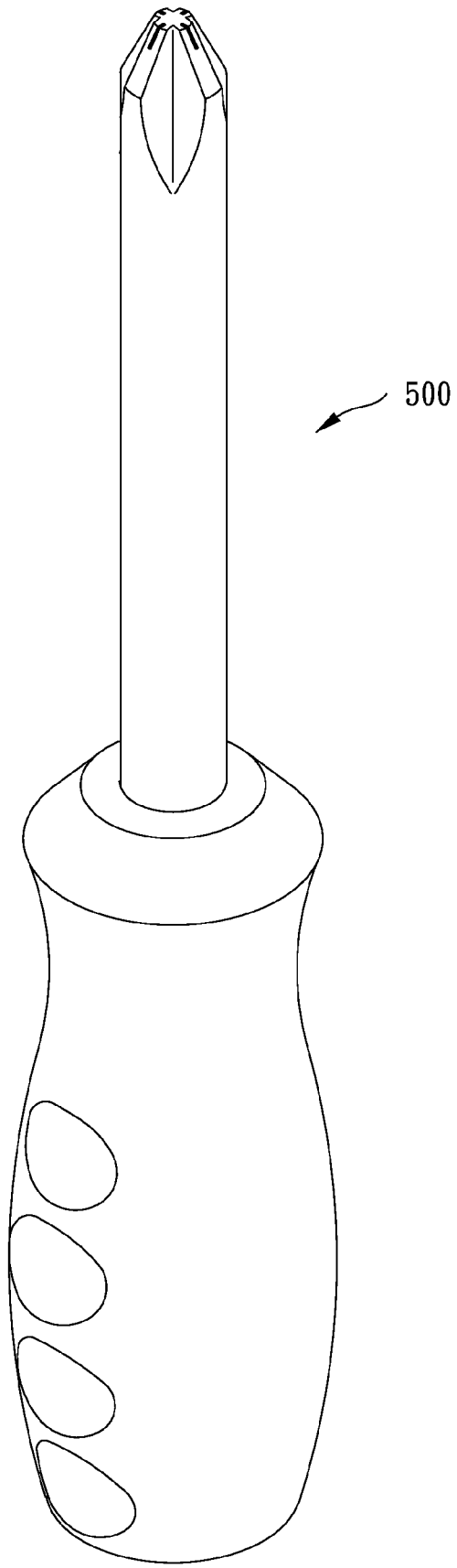
FIG. 7 is a view of a Phillips screwdriver according to a preferred embodiment of the present invention.
Figure 8:
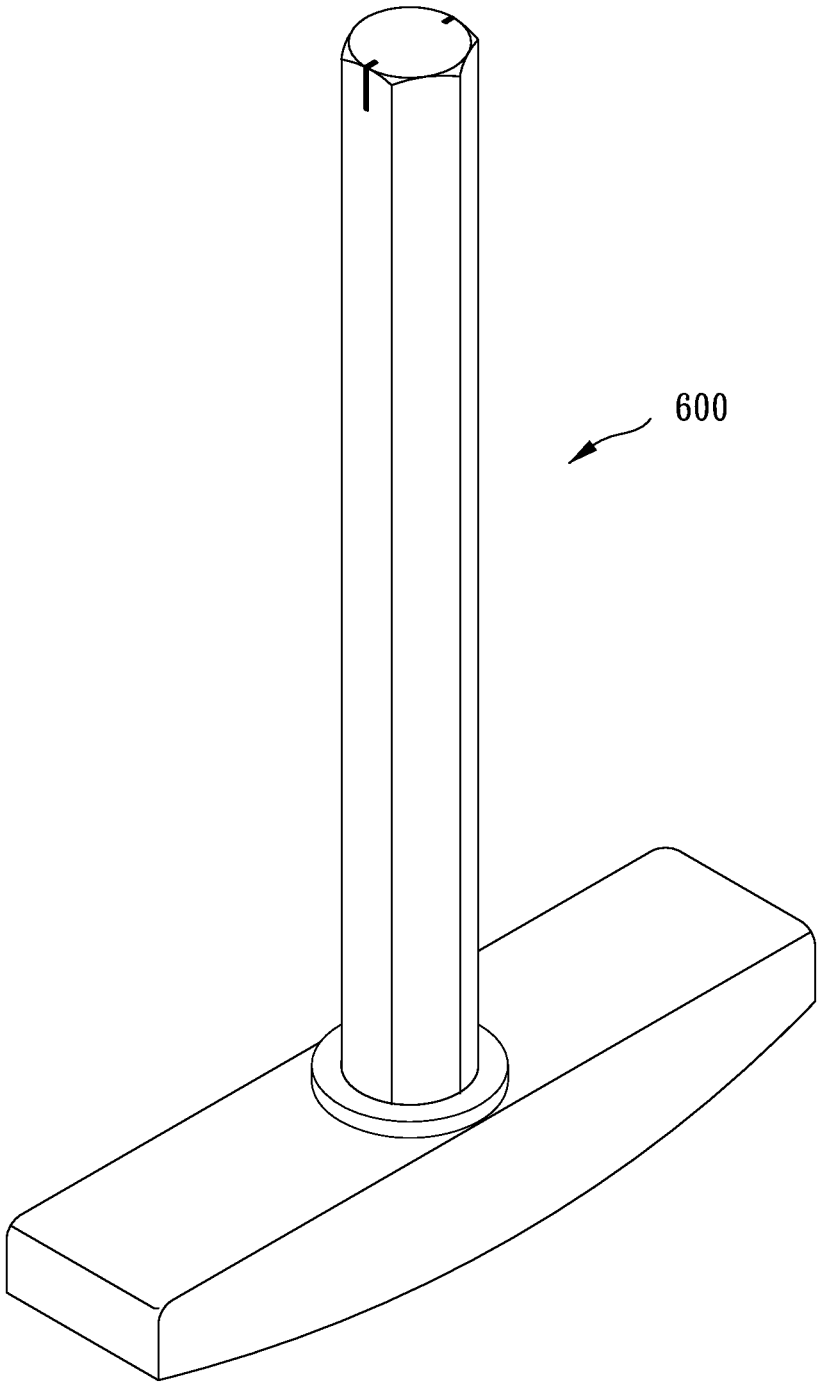
FIG. 8 is a view of a T-shaped tool according to a preferred embodiment of the present invention

It is noted that, in the aforementioned four embodiments, each groove has a rugged surface, whereby improving adhesion of the elastic member to the rugged surface; the groove may be formed as a text or number (for example, ½") which can represent the size corresponding to that of the tool head, and so does the elastic member. In the second to fourth embodiments, the elastic member is preferably colored. In the present invention, the operation portion of the tool head not only can be provided as polygonal for connection with a driving end of an assisting tool but also can be provided as a handle of a screwdriver 400 as shown in FIG. 6, or as a handle of a screwdriver 500 as shown in FIG. 7, or as a handle of an T-shaped tool 600 as shown in FIG. 8.

In the anti-disengagement structure of a tool head of the present invention, the working inserting section is at least partially formed with the groove, the groove is filled with the elastic member, and the elastic member is partially protrusive outside the groove. The above structure can provide the following advantageousness.

With the elastic member partially protrusive outside the groove, the largest extent of the working inserting section is greater than the largest inner extent of an insertion recess of a fastener. Additionally, the elastic member has elastic characteristic and can therefore be easy to insert into the insertion recess and urges against the inner surface of insertion recess, thus avoiding disengagement of the fastener from the tool head.

Compared to either of DE 4416268 and U.S. Pat. No. 6,302,001 in which the working end is formed with an annular slot, the groove is partially arranged so that the working inserting section has better structural strength and rigidity and this enhances the output torque of the tool head.

Compared to U.S. Pat. No. 6,302,001, two ‹-shaped grooves may be selectively disposed on two corresponding ‹-shaped abutting faces of a ball-shaped tool head, as described in the fourth embodiment, the transition interface of the ‹-shaped is not thinned or weakened and the elastic member is protrusive outside the groove, so that it can ensure that the elastic member can eventually abut against the inner surface of the insertion recess to avoid disengagement of the fastener from the tool head no matter when the ball-shaped tool head is perpendicularly (FIG. 5A) or non-perpendicularly (FIG. 5B) inserted into the hexagonal insertion recess.

The elastic member can not only avoid disengagement of the fastener from the tool head fastener unfastening but also serve as a recognizing mark (such as being colored) of size, type or application of a tool head. Compared to a conventional tool head with a color sleeve or annular flange, the invention requires no additional processing or fabrication procedures, thus being of low-cost.

The groove may be formed as slotted, crossed, hexagonal or ball-shaped according to various requirements of tool heads, and the elastic member is partially protrusive outside the groove and can be shaped to have a shape corresponding to the shape of the tool head (for example, the tool head is a hexagonal wrench and the protrusive portion of the elastic member is of hexagonal), such that an user can obtain the size, type and application of the tool head through touch in a dark environment. Alternatively, the groove may be formed as a text or number which can represent the size corresponding to that of the tool head, and the elastic member can enable an user to obtain the size, type and application of the tool head through touch.

Figure 2A:
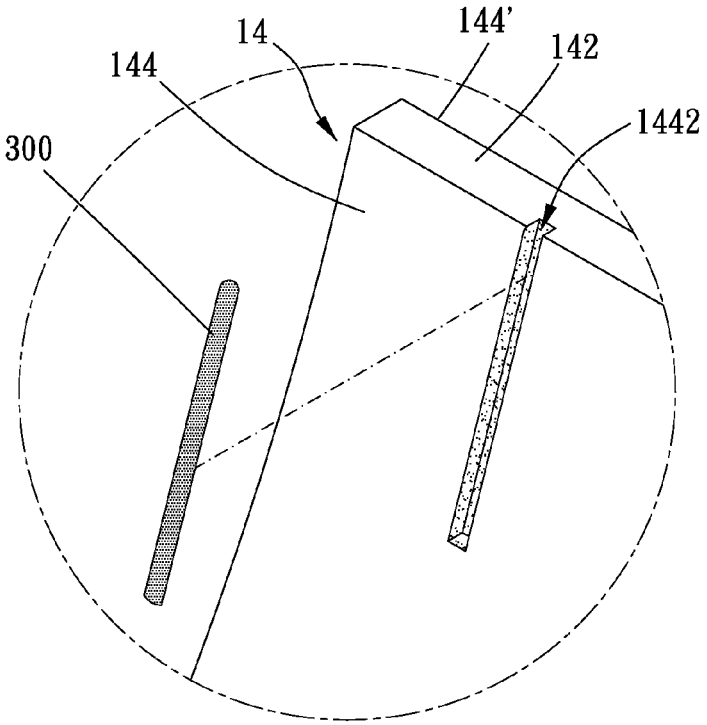
FIG. 2A is an enlarged view of FIG. 2.
Figure 2:
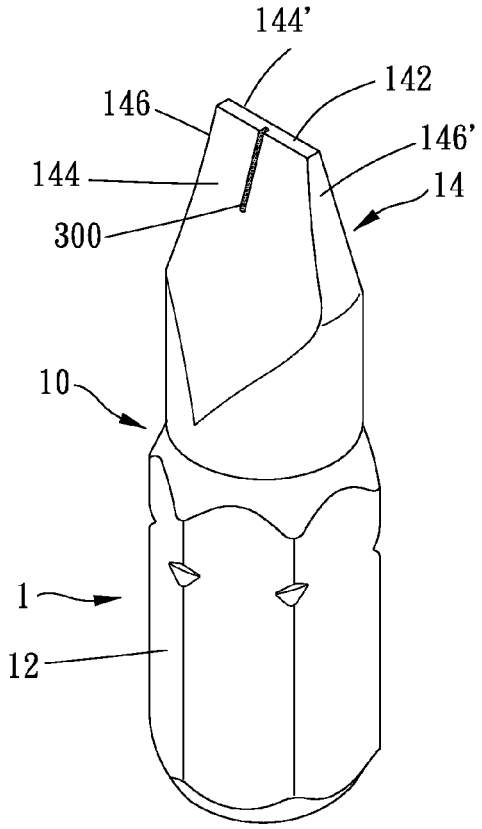
FIG. 2 is a view of a flat tool head.
Figure 2B:
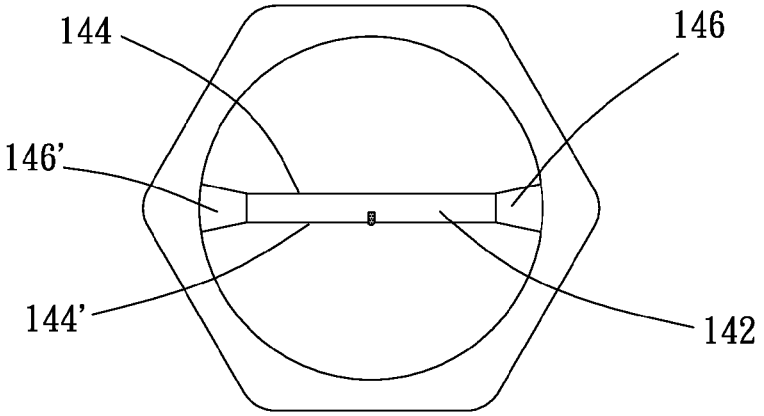
FIG. 2B is a top view of FIG. 2.
Figure 2C:
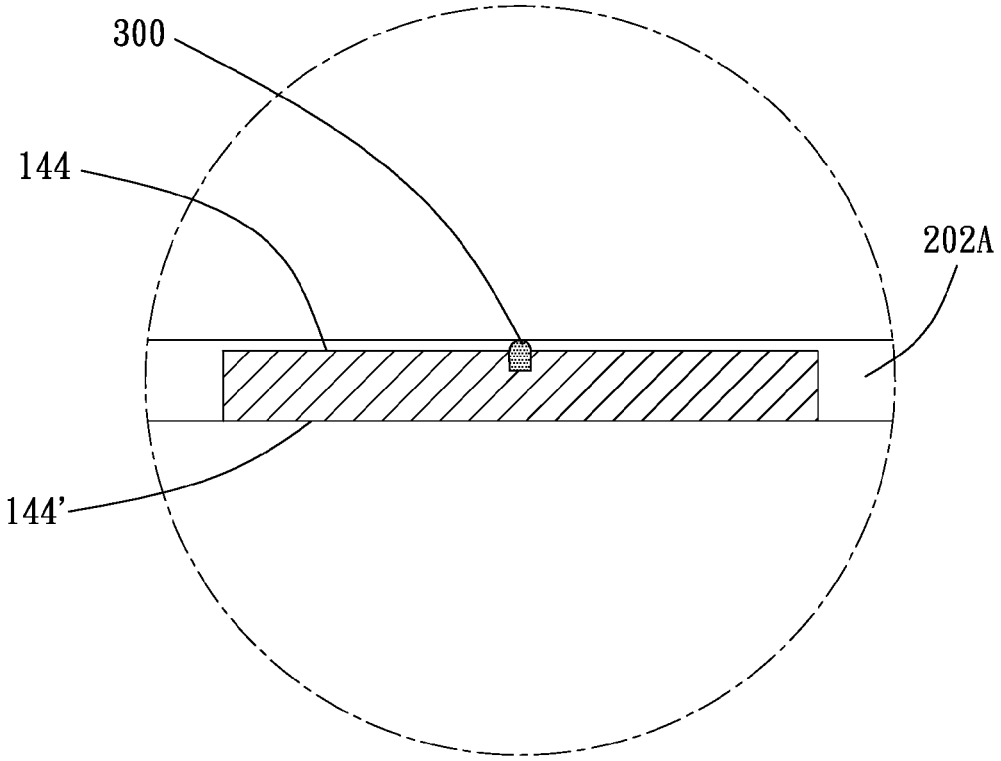
FIG. 2C is a cross-sectional view of FIG. 2.
Figure 2D:
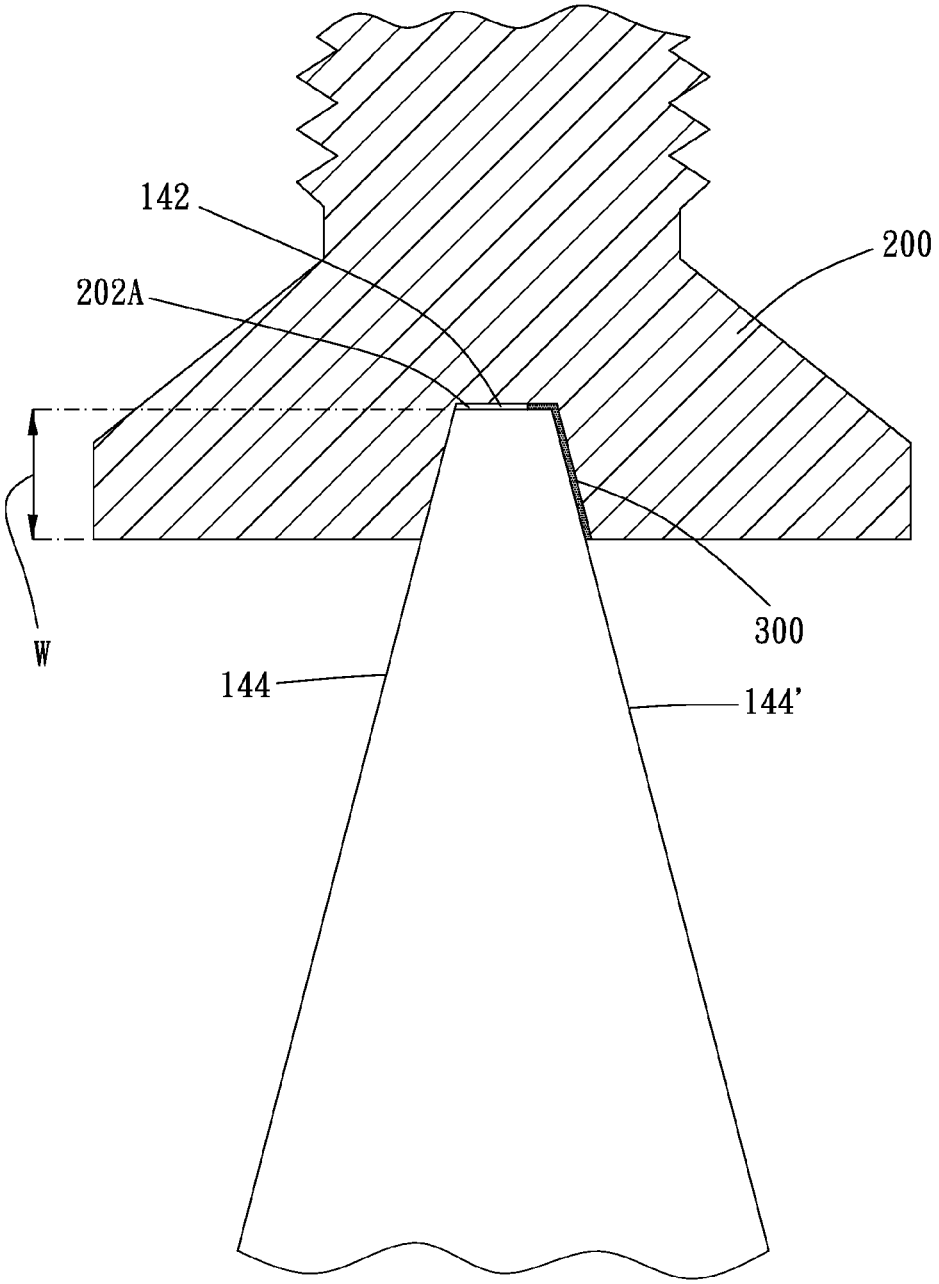
FIG. 2D is a drawing showing a flat tool head inserted into a fastener.
Figure 3C:
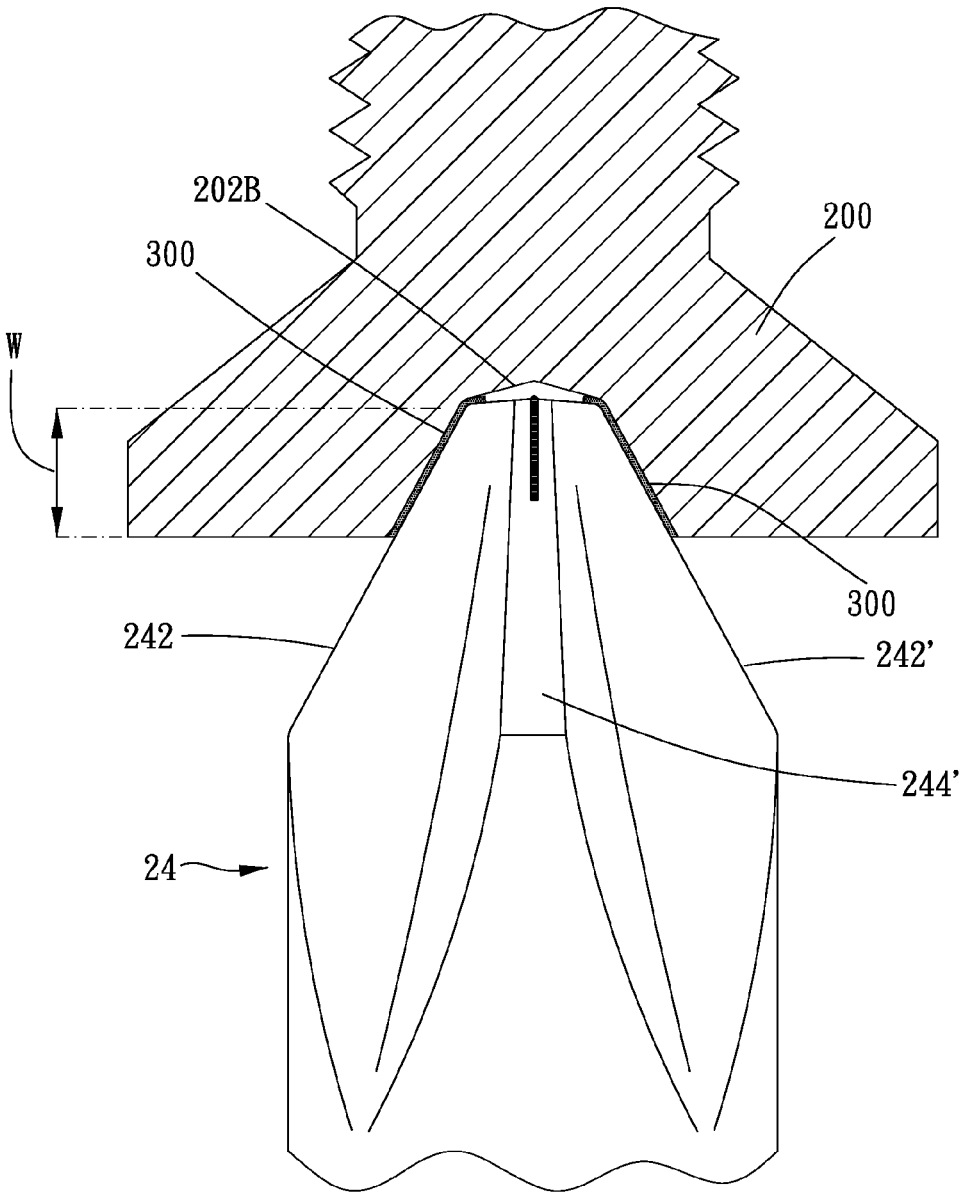
FIG. 3C is a drawing showing a Phillips tool head inserted into a fastener.
Figure 3D:
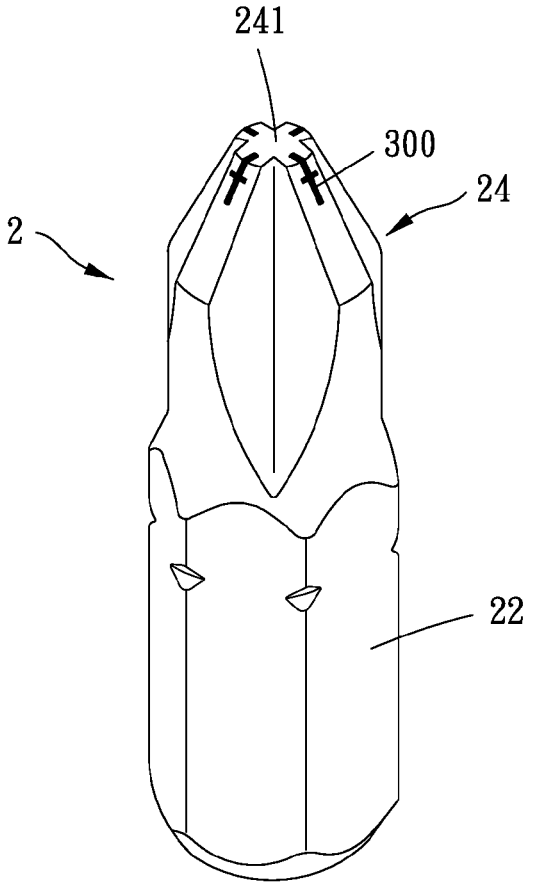
FIG. 3D is a view of another Phillips tool head.
Figure 3E:
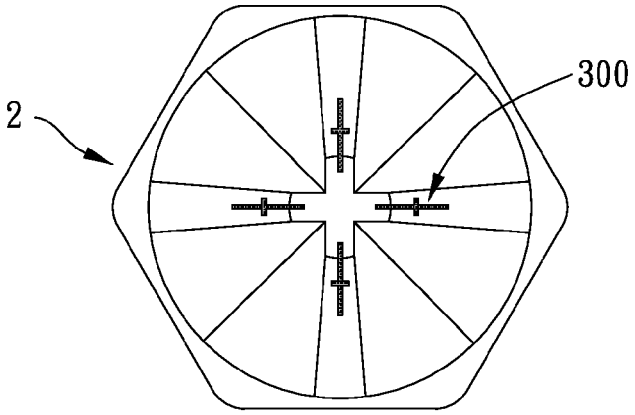
FIG. 3E is a top view of FIG. 3D.

Generally, to drive a fastener, a slotted, Phillips tool head is pressed and inserted into the insertion recess, and the tool head is then rotated to drive the fastener. However, the abutting faces can be damaged to form burrs, and the burrs can hurt the user when the tool head is exchanged. Besides, the burrs can cause that the largest extent of the working inserting section is greater than the largest inner extent of the insertion recess, which affects insertion of the working inserting section into the insertion recess. Turning to the invention, the elastic member extends and terminates at the end face and is protrusive outside the groove, and the elastic member abuts against the bottom surface of the insertion recess (FIG. 2D, FIG. 3C). As a result, the end face of the tool head can be avoided to directly contact the bottom surface of the insertion recess, thus ensuring that no burr can be formed on the working inserting section.

Compared to U.S. Pat. No. 5,259,280 and U.S. Pat. No. 6,883,405, since the elastic member which has elastic characteristic is protrusive outside the groove, it needs not to reduce the dimension of the working inserting section and the working inserting section therefore has better structural strength and rigidity, and the elastic member can be elastically contracted inwardly for insertion of the working inserting section into the insertion recess easily.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An anti-disengagement structure of a tool head for a fastener, for insertion into an insertion recess of the fastener to fasten or unfastening the fastener, the tool head including a main body, the main body having an operation portion and a working portion, the working portion axially integrally extending from one end of the operation portion, a top end of the working portion having an end face, at least two abutting faces extending from a periphery of the end face toward the operation portion, a depth of each of the abutting faces corresponding to one the insertion recess being defined as a working inserting section, the largest outer extent of the working inserting section being smaller than or equal to the largest inner extent of the insertion recess, at least one the abutting face corresponding to the working inserting section being formed with at least one groove, the groove being filled with an elastic member, part of the elastic member being protrusive outside the groove and exposed beyond the abutting face, the largest extent from the exposed part of the elastic member to another abutting face being greater than the largest inner extent of the insertion recess;

wherein the groove extends and terminates at the end face, the groove is filled with the elastic member, part of the elastic member is protrusive outside and beyond the end face, and the groove has a rugged surface.

2. An anti-disengagement structure of a tool head for a fastener, for insertion into an insertion recess of the fastener to fasten or unfastening the fastener, the tool head including a main body, the main body having an operation portion and a working portion, the working portion axially integrally extending from one end of the operation portion, a top end of the working portion having an end face, at least two abutting faces extending from a periphery of the end face toward the operation portion, a depth of each of the abutting faces corresponding to one the insertion recess being defined as a working inserting section, the largest outer extent of the working inserting section being smaller than or equal to the largest inner extent of the insertion recess, at least one the abutting face corresponding to the working inserting section being formed with at least one groove, the groove being filled with an elastic member, part of the elastic member being protrusive outside the groove and exposed beyond the abutting face, the largest extent from the exposed part of the elastic member to another abutting face being greater than the largest inner extent of the insertion recess;

wherein the groove extends and terminates at the end face, the groove is filled with the elastic member, part of the elastic member is aligned with the end face, and the groove has a rugged surface.

3. An anti-disengagement structure of a tool head for a fastener, for insertion into an insertion recess of the fastener to fasten or unfastening the fastener, the tool head including a main body, the main body having an operation portion and a working portion, the working portion axially integrally extending from one end of the operation portion, a top end of the working portion having an end face, at least two abutting faces extending from a periphery of the end face toward the operation portion, a depth of each of the abutting faces corresponding to one the insertion recess being defined as a working inserting section, the largest outer extent of the working inserting section being smaller than or equal to the largest inner extent of the insertion recess, at least one the abutting face corresponding to the working inserting section being formed with at least one groove, the groove being filled with an elastic member, part of the elastic member being protrusive outside the groove and exposed beyond the abutting face, the largest extent from the exposed part of the elastic member to another abutting face being greater than the largest inner extent of the insertion recess;

wherein the tool head is a Phillips tool head, the Phillips tool head includes a first abutting face, a second abutting face, a third abutting face and a fourth abutting face, the first and second abutting faces and the third and fourth abutting faces are crossed, each abutting face is formed with a respective one of the at least one groove, the groove is shaped as crossed, and the crossed groove is filled with the elastic member.

4. An anti-disengagement structure of a tool head for a fastener, for insertion into an insertion recess of the fastener to fasten or unfastening the fastener, the tool head including a main body, the main body having an operation portion and a working portion, the working portion axially integrally extending from one end of the operation portion, a top end of the working portion having an end face, at least two abutting faces extending from a periphery of the end face toward the operation portion, a depth of each of the abutting faces corresponding to one the insertion recess being defined as a working inserting section, the largest outer extent of the working inserting section being smaller than or equal to the largest inner extent of the insertion recess, at least one the abutting face corresponding to the working inserting section being formed with at least one groove, the groove being filled with an elastic member, part of the elastic member being protrusive outside the groove and exposed beyond the abutting face, the largest extent from the exposed part of the elastic member to another abutting face being greater than the largest inner extent of the insertion recess;

wherein the tool head is a hexagonal tool head, the hexagonal tool head includes six abutting faces sequentially connected, the groove is shaped as hexagonal, and the hexagonal groove is filled with the elastic member.

5. An anti-disengagement structure of a tool head for a fastener, for insertion into an insertion recess of the fastener to fasten or unfastening the fastener, the tool head including a main body, the main body having an operation portion and a working portion, a necked portion being formed between the working portion and the operation portion, a top end of the working portion having an end face, a plurality of < -shaped abutting faces which are sequentially connected extending from a periphery of the end face toward the operation portion, outmost parts of two corresponding < -shaped abutting faces defining a working inserting section, the largest outer extent of the working inserting section being smaller than or equal to the largest inner extent of the insertion recess, at least one the < -shaped abutting face corresponding to the working inserting section formed with a groove running through a transition interface of the at least one < -shaped abutting face, the groove being filled with an elastic member, part of the elastic member being protrusive outside the groove and exposed beyond the at least one the < -shaped abutting face, the largest extent from the exposed part of the elastic member to one the < -shaped abutting face opposite to the exposed part of the elastic member being greater than the largest inner extent of the insertion recess.

6. The anti-disengagement structure of a tool head for a fastener of claim 5, wherein the tool head is a substantially ball-shaped tool head, the < -shaped abutting face includes an upper ramp and a lower ramp which extend oppositely, and the groove continuously extends on the upper ramp and the lower ramp and travels through the transition interface of the upper ramp and the lower ramp.

* * * * *